US008444723B2

(12) United States Patent
Fujimori et al.

(10) Patent No.: US 8,444,723 B2
(45) Date of Patent: May 21, 2013

(54) FLUIDIZED BED GASIFICATION METHOD

(75) Inventors: Toshiro Fujimori, Koto-ku (JP); Hidehisa Tani, Koto-ku (JP); Toshiyuki Suda, Koto-ku (JP); Yoshiaki Matsuzawa, Koto-ku (JP); Kenichiro Kondo, Koto-ku (JP)

(73) Assignee: IHI Corporation, Tokyo (JP)

( * ) Notice: Subject to any disclaimer, the term of this patent is extended or adjusted under 35 U.S.C. 154(b) by 530 days.

(21) Appl. No.: 12/526,557

(22) PCT Filed: Mar. 1, 2007

(86) PCT No.: PCT/JP2007/000153

§ 371 (c)(1),
(2), (4) Date: Aug. 10, 2009

(87) PCT Pub. No.: WO2008/107928

PCT Pub. Date: Sep. 12, 2008

(65) Prior Publication Data

US 2010/0101146 A1 Apr. 29, 2010

(51) Int. Cl.

| | |
|---|---|
| ***C01B 3/36*** | (2006.01) |
| ***C01B 6/24*** | (2006.01) |
| ***C01B 3/02*** | (2006.01) |
| ***C10J 3/46*** | (2006.01) |
| ***B01J 7/00*** | (2006.01) |

(52) U.S. Cl.
USPC ..... 48/197 R; 48/61; 48/210; 423/644; 423/648.1

(58) Field of Classification Search
USPC ..... 48/197 R
See application file for complete search history.

(56) References Cited

U.S. PATENT DOCUMENTS

| | | | | |
|---|---|---|---|---|
| 3,205,065 | A * | 9/1965 | Mayer et al. | 75/447 |
| 4,211,606 | A * | 7/1980 | Ponomarev et al. | 201/12 |
| 4,391,612 | A * | 7/1983 | Chang | 48/202 |
| 2005/0261382 | A1 * | 11/2005 | Keyser et al. | 518/702 |

FOREIGN PATENT DOCUMENTS

| | | |
|---|---|---|
| JP | 51-142873 | 12/1976 |
| JP | 2003-176486 | 6/2003 |
| JP | 2004-162977 | 6/2004 |
| JP | 2005-41959 | 2/2005 |
| JP | 2005-112956 | 4/2005 |
| JP | 2005-314549 | 11/2005 |
| JP | 2006-292275 | 10/2006 |
| JP | 2007-24492 | 2/2007 |

OTHER PUBLICATIONS

U.S. Appl. No. 12/526,598, filed Aug. 10, 2009, Suda, et al.
U.S. Appl. No. 12/530,789, filed Sep. 11, 2009, Matsuzawa, et al.

* cited by examiner

*Primary Examiner* — Matthew Merkling
(74) *Attorney, Agent, or Firm* — Oblon, Spivak, McClelland, Maier & Neustadt, L.L.P.

(57) ABSTRACT

Provided is a fluidized bed gasification method wherein an amount of solid particles to be circulated in a fluidized bed combustion furnace is controlled to enhance gasification efficiency in the furnace.

It is the fluidized bed gasification method with fluidized bed combustion and gasification furnaces 30 and 43, char and solid particles produced upon gasification of raw material 51 in the gasification furnace 43 being circulated to the combustion furnace 30. A circulated amount of the solid particles in the combustion furnace is controlled by varying the same in a range of 6 to 30 with respect to an air flow rate, thereby facilitating heat transmission to the raw material 51.

8 Claims, 3 Drawing Sheets

FLUIDIZED BED GASIFICATION METHOD

TECHNICAL FIELD

The present invention relates to a fluidized bed gasification method for gasifying raw material by means of a fluidized bed.

BACKGROUND ART

It has been recently proposed a fluidized bed gasification method for gasification of raw material such as coal or biomass, using a circulating fluidized bed furnace with fluidized bed combustion and gasification furnaces which is called twin-towered gasification furnace (see Reference 1).

FIG. 1 shows a circulating fluidized bed furnace according to the Reference 1 which comprises a fluidized bed combustion furnace 1 supplied with air for combustion of char by means of a fluidized bed so as to heat solid particles such as sand (bed material or fluid medium). In the fluidized bed combustion furnace 1, char and solid particles are introduced from below while supplementary fuel F is supplied through a lateral supplementary raw material port 2. The fluidized bed combustion furnace 1 is provided at its bottom with a wind box 4 connected to an air supply line 3 for blowing of air, and at its top with a heat exchanger 5 for heat recovery.

The top of the fluidized bed combustion furnace 1 is connected through a transfer pipe 7 to a separator 6 comprising a cyclone. The separator 6 has outer and inner cylinders 8 and 9, burnt gas (hot fluid) 10 from the fluidized bed combustion furnace 1 being introduced via the transfer pipe 7 tangentially into the outer cylinder 8 where it is centrifuged into solid particles 11 and exhaust gas 12. The exhaust gas 12 with fine-grained ash is discharged through the inner cylinder 9 while the solid particles 11 with rough-grained unburned char is supplied to a fluidized bed gasification furnace 14 via a downcomer 13 extending downward from a lower end of the outer cylinder 8 of the separator 6.

The fluidized bed gasification furnace 14 comprises an introductory portion 15 for introduction of the hot solid particles 11, a gasification portion 18 for gasification of raw material 17 such as coal from a raw material supply device 16 through heat from the solid particles 11, a lower communicating portion 20 for communication between the introductory and gasification portions 15 and 18 at a lower part of the fluidized bed 19 so as to allow the movement of the particles and a gasification agent box portion 21 extending over bottoms of the portions 15, 18 and 20 for supply of the gasification agent such as steam into the fluidized bed gasification furnace 14, the box portion 21 being connected with a gasification agent supply line 22. As shown in FIG. 1, the lower communicating portion 20 within the fluidized bed 19 is in the form of a backflow prevention structure for prevention of backflow of the burnt gas in the fluidized bed combustion furnace 1 into the separator 6.

The char not gasified in the gasification portion 18 and the solid particles are supplied for circulation to the fluidized bed combustion furnace 1 via a supply flow passage 23 comprising for example an overflow pipe, the char being burnt out with the air under a condition of air ratio being 1.2 while the solid particles are heated again by the combustion of the char.

If coal is fed as raw material to be gasified to the gasification portion 18, produced is produced gas 24 mixed with gas components such as hydrogen ($H_2$), carbon monoxide (CO) and methane ($CH_4$); if biomass or the like with a high water content is fed as raw material to be gasified, produced is produced gas 24 with the above-mentioned gas components containing much steam. The produced gas 24 is taken out via a discharge pipe 25 from the fluidized bed gasification furnace 14 into a recovery device 26 where the produced gas 24 is separated from impalpable powder 27 having been entrained in the gas and is derived through an inner pipe 28. The produced gas 24 thus derived may be pressurized and supplied as fuel to, for example, a gas turbine, or may be supplied to a refinery for production of any required gas from the produced gas 24.

[Reference 1] JP2005-41959A

SUMMARY OF THE INVENTION

Problems to be Solved by the Invention

However, in the conventional fluidized bed gasification method where fluidized bed combustion furnace 1 is provided at its wall or inside with a steam generating pipe and a heat exchanger 5 such as a gas heat exchanger, combustion heat in the fluidized bed combustion furnace 1 may be brought outside of the furnace thorough steam or heated gas, so that combustion heat cannot be sufficiently supplied to the solid particles 11, which may bring about lowering in temperature of the fluidized bed in the fluidized bed gasification furnace 14, disadvantageously resulting in lowering in gasification efficiency of the raw material.

In order to enhance the gasification efficiency of the raw material, fluidized bed combustion furnace 1 in the form of a heat insulation structure may be operated under a normal air ratio to simply increase the temperature in the fluidized bed combustion furnace 1 for increase of the combustion heat supplied to the solid particles; this may, however, cause the temperature in the fluidized bed combustion furnace 1 to exceed an ash fusion temperature of the raw material, disadvantageously resulting in agglomeration and/or sintering of the solid particles within the fluidized bed combustion furnace 1.

In order to overcome this, the air ratio to char in the fluidized bed combustion furnace 1 may be increased to lower the temperature in the fluidized bed combustion furnace 1; this may, however, bring about increase in exhaust loss of the fluidized bed combustion furnace 1, resulting in lowering in gasification efficiency of the raw material. If the air ratio to char is lowered below 1, then the fluidized bed combustion furnace 1 may be fed with much char to bring about too much fuel and cause the air ratio in the fluidized bed combustion furnace 1 being below sound operating condition, disadvantageously resulting in increase of unburned fuel and increase of CO concentration.

In this connection, a circulated amount of the solid particles to air flow rate (solid/gas ratio) in the conventional boiler-structured fluidized bed combustion furnace 1 is taken into consideration under the condition that the operating temperature in the furnace is 800° C.-1100° C. when the raw material is coal and is less than 800° C. when the raw material is biomass, the air ratio being kept to 1.2 or so. In the conventional boiler and when the amount of the solid particles circulated (solid/gas ratio) is conventional or 2.5-4 or so, heat transmitted to the furnace walls may be increased due to sensible heat from the solid particles such as sand into an amount more than that can be absorbed by the heat exchanger, so that the amount of the solid particles circulated (solid/gas ratio) to the air flow rate cannot be increased more than 2.5-4 or so. Therefore, even greater heat transfer to the solid particles such as sand has been desired without use of the heat exchanger serving as boiler.

The invention was made in view of the above conventional problems and has its object to provide a fluidized bed gasification method in which a circulated amount of solid particles in a fluidized bed combustion furnace can be controlled to enhance gasification efficiency in a fluidized bed gasification furnace.

Means or Measures for Solving the Problems

A fluidized bed gasification method according to the invention is directed to a fluidized bed gasification method wherein a fluidized bed combustion furnace is provided for combustion of char so as to heat solid particles, the solid particles being separated from hot fluid derived from the fluidized bed combustion furnace, the separated solid particles being introduced into a fluidized bed gasification furnace, raw material being introduced into said fluidized bed gasification furnace, the raw material being gasified by a fluidized bed supplied with a gasification agent in said fluidized bed gasification furnace to take out produced gas, char produced upon the gasification of the raw material and the solid particles being circulated to said fluidized bed combustion furnace for combustion of the char, said fluidized bed gasification method comprising varying a circulated amount of the solid particles in said fluidized bed combustion furnace in a range of 6 to 30 to an air flow rate.

The circulated amount of the solid particles in the fluidized bed combustion furnace (solid/gas ratio) may be in a range of 8 to 15 to the air flow rate.

Preferably, an operating temperature in the fluidized bed combustion furnace is lower than an ash fusion temperature of the raw material.

More preferably, the operating temperature in the fluidized bed combustion furnace is lower then the ash fusion temperature of the raw material by 100° C.

Solid particles may be supplied to the fluidized bed combustion furnace or/and fluidized bed gasification furnace to increase the circulated amount of the solid particles.

The solid particles may be discharged from the fluidized bed combustion furnace or/and fluidized bed gasification furnace to decrease the circulated amount of the solid particles.

Introduction ratio may be varied between a flow rate of primary air introduced via a bottom of the fluidized bed combustion furnace and a flow rate of secondary air introduced sideways of the fluidized bed combustion furnace.

In order to accelerate flow velocity of the fluidizing solid particles, the fluidized bed combustion furnace may be selected which has smaller inner diameter.

The raw material may be selected from a group consisting of coal, sub-bituminous coal, brown coal, lignite, biomass, waste plastic, heavy oil, residual oil and oil shale.

Effects of the Invention

According to a fluidized bed gasification method of the invention, the circulated amount of the solid particles in the fluidized bed combustion furnace (solid/gas ratio) is varied in a range of 6 to 30 with respect to air flow rate, with excellent effects or advantages that the circulated amount of the solid particles may be controlled so as to accelerate heat transmission in the fluidized bed combustion furnace, to increase heat amount to be fed to the fluidized bed gasification furnace to increase the temperature in the fluidized bed gasification furnace and to enhance the gasification efficiency in the fluidized bed gasification furnace.

Figure 1:
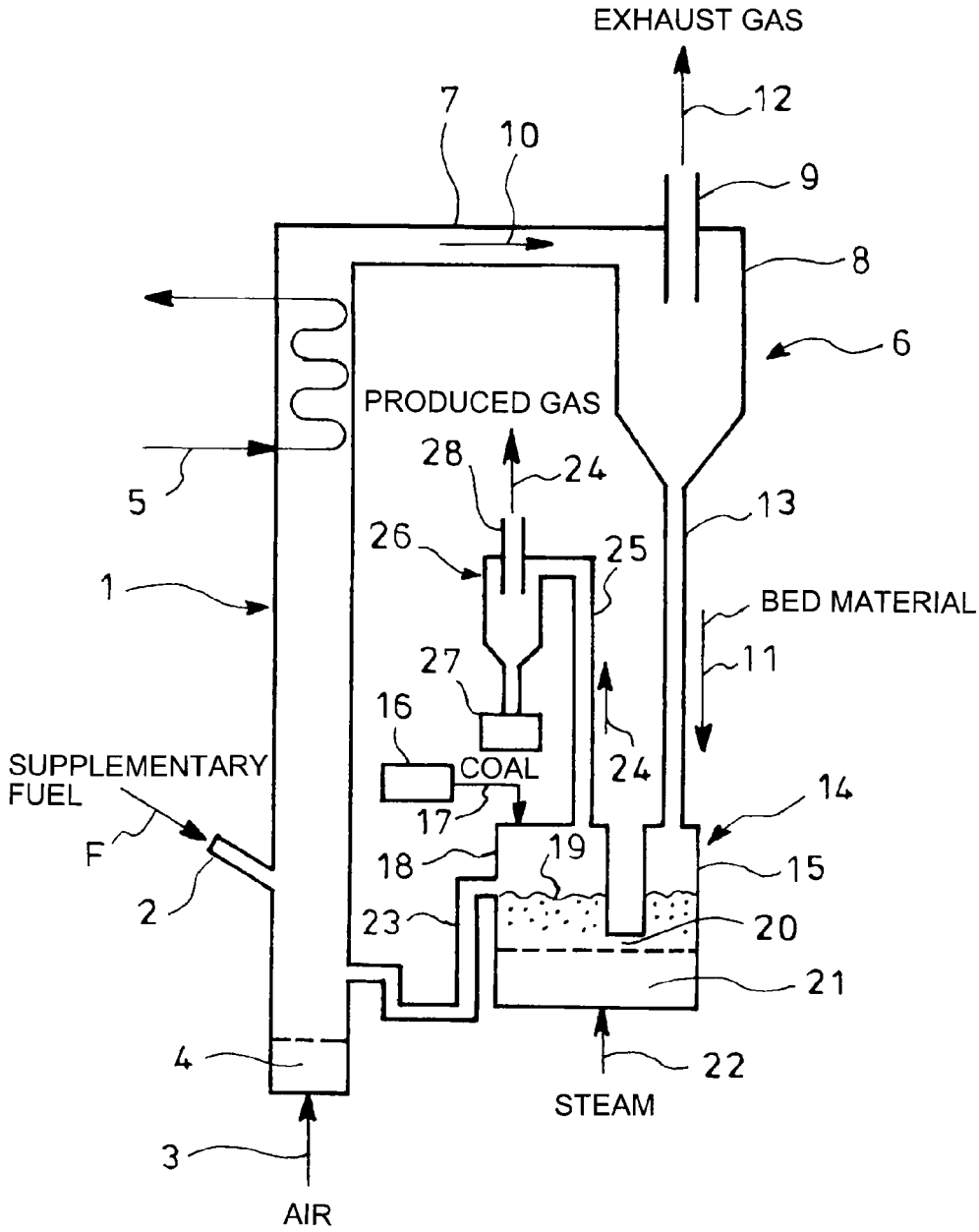
FIG. 1 is a side view showing an example of a conventional fluidized bed gasification method.

| Explanation of the Reference Numerals | |
|---|---|
| 30 | fluidized bed combustion furnace |
| 38 | separator |
| 39 | hot fluid (burnt gas) |
| 40 | solid particles |
| 42 | downcomer |
| 43 | fluidized bed gasification furnace |
| 46 | fluidized bed |
| 51 | raw material |
| 52 | produced gas |
| 53 | supply flow passage |

BEST MODE FOR CARRYING OUT THE INVENTION

An embodiment of the invention will be described in conjunction with attached drawings.

Figure 2:
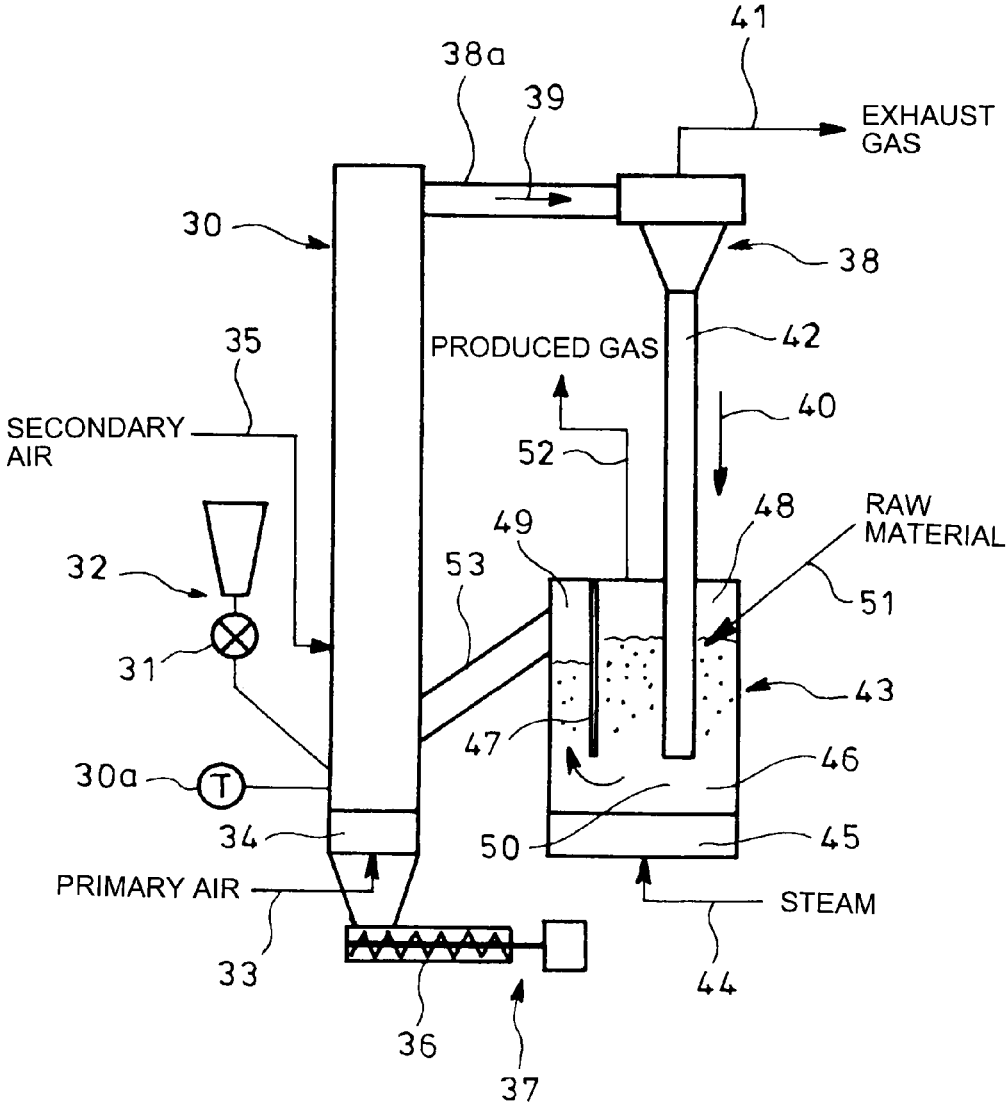
FIG. 2 is a side view showing an embodiment of the invention.
Figure 3:
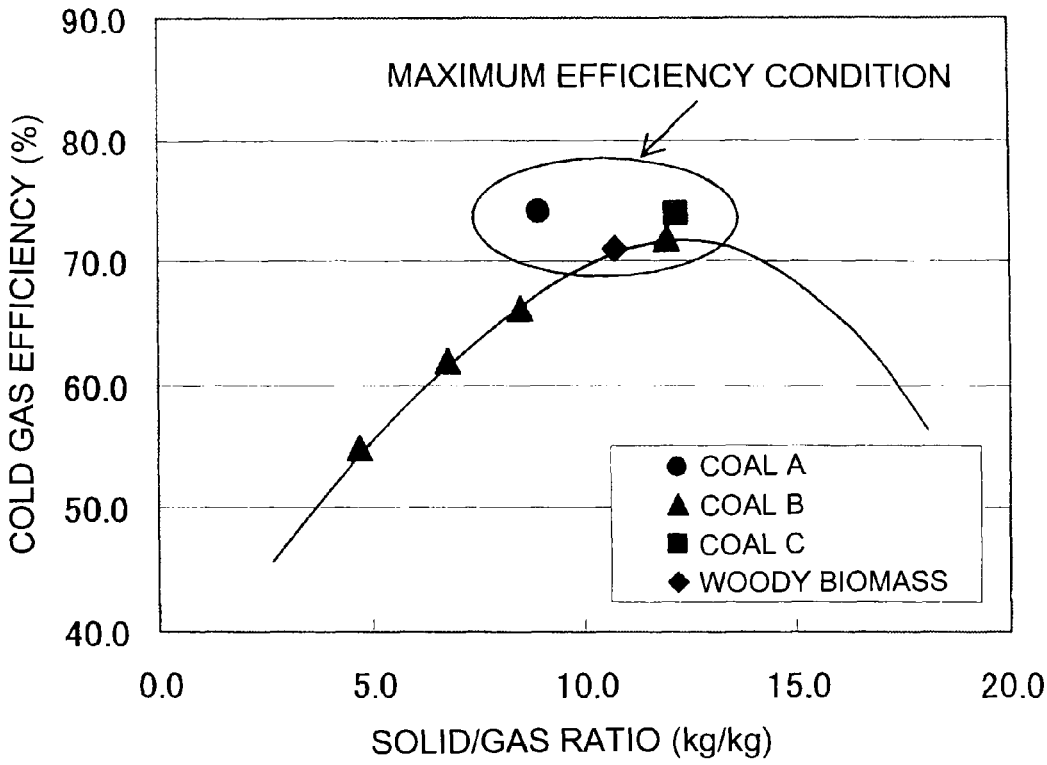
FIG. 3 is a graph showing a circulated amount (solid/gas ratio) of sand (solid particles).

FIGS. 2 and 3 show the embodiment of the invention wherein a fluidized bed combustion furnace 30 is provided for combustion of char to heat solid particles such as sand (bed material or fluid medium), the fluidized bed combustion furnace 30 being in the form of a heat insulation structure having no heat exchanger for heat recovery within, the fluidized bed combustion furnace 30 being fed at its lower portion with the char and the solid particles and being provided with a particle supplying device 32 for supply of new solid particles through, for example, a rotary feeder 31. The fluidized bed combustion furnace 30 is provided at its bottom with a wind box 34 connected to a primary air supply line 33 for blowing of primary air and at its side (side center in FIG. 2) with a secondary air supply line 35 for blowing of secondary air. Further, the wind box 34 is formed at its bottom with a particle takeoff device 37 for discharge of the solid particles in the fluidized bed combustion furnace 30 to outside through, for example, a screw conveyor 36. The lower portion of the fluidized bed combustion furnace 30 is further provided with a thermometer 30*a* for measurement of temperature of the fluidized bed.

An upper portion of the fluidized bed combustion furnace 30 is connected via a transfer pipe 38*a* to a separator 38 comprising a cyclone. Thus burnt gas (hot fluid) 39 is derived from the fluidized bed combustion furnace 30 via the transfer pipe 38 into the separator 38 where it is centrifuged into solid particles 40 and exhaust gas 41, the exhaust gas 41 with fine-grained ash being discharged to a supply destination while the solid particles 40 with rough-grained unburned char is supplied to a fluidized bed gasification furnace 43 through a downcomer 42 connected to and extending from a lower end of an outer cylinder of the separator 38. Preferably, the fluidized bed combustion furnace 30 has a smaller inner diameter.

The fluidized bed gasification furnace 43 is provided at its lower portion with a gasification agent box 45 for introduction of a gasification agent 44 such as steam. The fluidized bed gasification furnace 43 is partitioned into first and second chambers 48 and 49 by partition means in the form of a partition wall 47 extending in the fluidized bed 46 from upward, the first chamber 48 having a greater capacity while the second chamber 49 has a smaller capacity. Formed between a lower end of the partition wall 47 and the gasification agent box 45 is a lower communicating portion 50 for communication between the first and second chambers 48 and 49 through inside of the fluidized bed 46. Just like the fluidized bed combustion furnace 30, the fluidized bed gasification furnace 43 may be provided with a particle supplying device 32 for supply of new solid particles via, for example, a rotary feeder 31 and/or a particle takeoff device 37 for discharge of the solid particles to outside through, for example, a screw conveyor 36.

To the first chamber 48, the hot solid particles 40 are introduced via the downcomer 42 and organic or other raw material 51 such as coal for gasification is supplied via raw material supply device (not shown) such as a screw feeder.

In the first chamber 48, the raw material 51 such as coal is heated into gasification by the solid particles in the fluidized bed fluidized by the gasification agent 44 to produce produced gas 52 mainly comprising, for example, hydrogen ($H_2$), carbon monoxide (CO), carbon dioxide ($CO_2$) and methane ($CH_4$). In the case where the raw material 51 is biomass, steam is also produced. The raw material 51 is being selected from a group consisting of, for example, coal, subbituminous coal, brown coal, lignite, biomass, waste plastic, heavy oil, residual oil and oil shale. Upon supply, any one of the kinds of raw material may be supplied; alternatively, a number of kinds of raw material may be supplied; if treated by gasification, other kind of raw material may be supplied.

Opened and connected to the second chamber 49 at a surface layer in the fluidized bed 46 is an upper end of a slant pipe or supply flow passage 53 a lower end of which is opened and connected to an inner lower portion of the fluidized bed combustion furnace 30, whereby the solid particles in the second chamber 49 and char produced by the gasification are supplied for circulation to the fluidized bed combustion furnace 30 via the supply flow passage 53.

In a case where the raw material 51 is gasified by means of, for example, the fluidized bed combustion and gasification furnaces 30 and 43, the hot fluid or burnt gas 39 from the fluidized bed combustion furnace 30 is separated from the solid particles 40 in the separator 38, the solid particles 40 separated in the separator 38 being introduced into the fluidized bed gasification furnace 43 through the downcomer 42 while the raw material 51 is introduced into the fluidized bed gasification furnace 43 from the raw material supplying device (not shown). The raw material 51 is gasified in the fluidized bed gasification furnace 43 by the fluidized bed supplied with the gasification agent to take off the produced gas.

Meanwhile, in the fluidized bed combustion furnace 30, the solid particles and the char produced upon gasification of the raw material 51 in the fluidized bed gasification furnace 43 are supplied for circulation through the supply flow passage; the char and the solid particles are fluidized by the primary air blown out from the wind box 34 and the secondary air blown out from the secondary air supply line 35 while the char is sufficiently burned to heat the solid particles.

In this time, in order to make the operating temperature in the fluidized bed combustion furnace 30 as high as appropriate as possible and lower than the ash fusion temperature of the raw material 51, it is controlled on the basis of detected temperature from the thermometer 30*a* and under a condition that it is lower than the ash fusion temperature of the raw material 51 by about 100° C. In order to sufficiently consume oxygen in the combustion air and make unburned combustibles not exceeding an allowable value, the air ratio is kept to be 1.2-1.3. Moreover, the circulated amount of the solid particles to the air flow rate in the fluidized bed combustion furnace 30 (solid/gas ratio) is made to be within a range of 6 to 30, preferably within a range of 8-15 and especially preferably within a range of 9-13.

The inventors, using the above-mentioned fluidized bed combustion furnace and fluidized bed gasification furnace 43, gasified the raw materials 51 of the coal kind shown in Table 1 below, i.e., coals A, B and C and woody biomass, and measured their gasification efficiencies (cold gas efficiencies); the results are shown in "cold gas efficiencies" in Table 1 and in FIG. 3. In the measurement, changes of solid/gas ration in coal B were measured as shown in FIG. 3. In this respect, the gasification efficiency (cold gas efficiency) is derived from (heat release value of gasified gas in cold state)/(heat release value of coal).

TABLE 1

Gasification efficiencies in various kinds of coal

| coal kind | coal A | coal B | coal C | woody biomass |
|---|---|---|---|---|
| Heat release value HHV kcal/kg-dry | 6,901 | 6,574 | 6,983 | 4,058 |
| Water content % by weight - as received basis | 25.0 | 35.1 | 6.8 | 10.9 |
| C % by weight - daf | 74.3 | 69.2 | 80.9 | 48.5 |
| H | 5.6 | 4.8 | 5.2 | 6.0 |
| O | 18.9 | 24.6 | 11.8 | 45.3 |
| N | 1.1 | 1.3 | 1.7 | 0.1 |
| S | 0.1 | 0.0 | 0.6 | 0.0 |
| Ash fusion temperature ° C. | 1,260 | 1,240 | 1,516 | |
| Air ratio | 1.2 | 1.2 | 1.2 | 1.3 |
| Solid/gas ratio kg/kg | 9.0 | 12.0 | 12.2 | 10.8 |
| Cold gas efficiency % | 74.0 | 71.8 | 73.8 | 71.0 |

According to FIG. 3, the proper gasification efficiency (cold gas efficiency) of 55% or more is indicated when the solid/gas ratio stands at more than 6. Further, according to FIG. 3 and Table 1, preferred gasification efficiency (cold gas efficiency) of 65% or more is indicated when the solid/gas ratio is kept in a range of 8 to 15; optimum gasification efficiency (cold gas efficiency) of 70% or more is indicated when the solid/gas ratio is in the range of 9 to 13 (maximum efficiency condition). It is to be noted that the gasification efficiency (cold gas efficiency) is lowered as the solid/gas ratio exceed the value of 15 and that the range of solid/gas ratio up to 30 is a limit of keeping proper gas efficiency.

Thus, it is apparent that, by controlling the operating temperature in the fluidized bed combustion furnace 30 to a proper temperature which is lower than the ash fusion temperature of the raw material 51 by about 100° C. and which is as high as possible and not exceed the as fusion temperature of the raw material 51, by keeping the air ratio of 1.2-1.3 and adjusting the circulated amount of the solid particles to the air flow rate (solid/gas ratio) to the air flow rate within the range of 6 to 30, combustion heat can be sufficiently transferred to the solid particles in the fluidized bed combustion furnace 30 to attain proper gasification in the fluidized bed gasification furnace 43, using the solid particles as heat source for said fluidized bed gasification furnace 43.

Thus, in the embodiment of FIGS. 2 and 3, the circulated amount of the solid particles (solid/gas ratio) to the air flow rate in the fluidized bed combustion furnace 30 in the form of heat insulation structure is varied in a range of 6 to 30, so that combustion heat in the fluidized bed combustion furnace 30 can be properly transferred to the solid particle to increase heat value supplied to the fluidized bed gasification furnace 43 and enhance the temperature in the fluidized bed gasification furnace 43 to enhance the gasification efficiency of the raw material 51. If the circulated amount of the solid particles (solid/gas ratio) to the air flow rate is made lower than 6, there may be a problem that heat may not be sufficiently transferred to the solid particles. If the circulated amount of the solid particles (solid/gas ratio) to the air flow rate is made larger than 30, then the circulated amount of the solid particles (solid/gas ratio) becomes to much, the temperature of the solid particles such as sand is lowered because of the heat value of the fuel being constant, disadvantageously resulting in lowering of gasification efficiency.

With the circulated amount of the solid particles in the fluidized bed combustion furnace (solid/gas ratio) to the air flow rate being in a range of 8 to 15, the combustion heat in the fluidized bed combustion furnace 30 can be sufficiently transferred to the solid particles to increase the heat value supplied to the fluidized bed gasification furnace 43, thereby enhancing the gasification efficiency of the raw material 51; especially with the circulated amount of the solid particles (solid/gas ratio) to the air flow rate being in a range of 9 to 13 as the maximum efficiency condition in FIG. 3, the combustion heat in the fluidized bed combustion furnace 30 can be sufficiently transferred to the solid particles to optimize the gasification efficiency of the raw material 51.

Further, since the circulated amount of the solid particles in the fluidized bed combustion furnace 30 (solid/gas ratio) to the air flow rate can be adjusted in a range of 6 to 30, the dwell time of solid particles in in the fluidized bed combustion furnace 30 may be prolonged to burn the unburned fuel and keep the air ratio in the fluidized bed combustion furnace 30 to a proper operating condition, thereby attaining the lowering of the CO concentration and the decrease of $NO_x$. Since the gasification efficiency of the raw material 51 is enhanced, the char supplied to the fluidized bed combustion furnace 30 can be decreased to suppress the fuel from being excessively supplied to the fluidized bed combustion furnace 30.

In the embodiment of FIGS. 2 and 3, when the operating temperature in the fluidized bed combustion furnace is set to a temperature lower than the ash fusion temperature of the raw material 51, the agglomeration and sintering of the solid particles can be prevented even if the temperature in the fluidized bed combustion furnace 30 is increased to increase the combustion heat to the solid particles under the normal condition of the air ratio being 1.2. When the operating temperature in the fluidized bed combustion furnace is made lower than the ash fusion temperature of the raw material 51 by 100-200° C., the agglomeration and sintering of the solid particles in the fluidized bed combustion furnace 30 can be surely prevented.

When solid particles are supplied to the fluidized bed combustion furnace 30 or/and fluidized bed gasification furnace 43 to increase the circulated amount of the solid particles, or when the solid particles are discharged from the fluidized bed combustion furnace 30 or/and fluidized bed gasification furnace 43 to lower the circulated amount of the solid particles, the circulated amount of the solid particles in the fluidized bed combustion furnace 30 (solid/gas ratio) can be increased/decreased, whereby temperatures of the fluidized bed combustion furnace 30 and fluidized bed gasification furnace 43 can be properly controlled and the produced amount of the produced gas from the raw material 51 and the gasification efficiency can be easily adjusted.

When introduction ratio between the flow rate of the primary air introduced via the bottom of the fluidized bed combustion furnace 30 and the flow rate of the secondary air introduced sideways of the fluidized bed combustion furnace 30 is varied, then the flow velocity of the solid particles in the fluidized bed combustion furnace 30 can be adjusted, so that when the flow velocity is adjusted to increase the circulated amount of the solid particles (solid/gas ratio), the combustion heat in the fluidized bed combustion furnace 30 can be properly transferred to the solid particles to enhance the gasification efficiency of the raw material 51. Even if part of the fuel cannot be burned with the primary air flow rate, the flow rate of the secondary air may be increased to burn such unburned part of the fuel, thereby suppressing CO and $NO_x$ from being produced in the fluidized bed combustion furnace 30.

When the fluidized bed combustion furnace 30 with smaller inner diameter is selected in order to accelerate the flow velocity of the fluidizing solid particles, the circulated amount of the solid particles is increased, so that combustion heat in the fluidized bed combustion furnace 30 can properly transferred to the solid particles to enhance the gasification efficiency of the raw material 51.

When the raw material 51 is selected from a group consisting of coal, sub-bituminous coal, brown coal, lignite, biomass, waste plastic, heavy oil, residual oil and oil shale, the raw material 51 can be properly gasified to enhance the gasification efficiency of the raw material 51.

Industrial Applicability

In the fluidized bed gasification method of the invention, the circulated amount of the solid particles in the fluidized bed combustion furnace (solid/gas ratio) to the air flow rate is increased within a range of 6 to 30 to properly transfer the combustion heat in the fluidized bed combustion furnace to the solid particles, thereby attaining high gasification efficiency.

The invention claimed is:

1. A fluidized bed gasification method wherein a fluidized bed combustion furnace is provided for combustion of char so as to heat solid particles, the solid particles being separated from hot fluid derived from the fluidized bed combustion furnace, the separated solid particles being introduced into a fluidized bed gasification furnace, raw material being introduced into said fluidized bed gasification furnace, the raw material being gasified by a fluidized bed supplied with a gasification agent in said fluidized bed gasification furnace to take out produced gas, char produced upon the gasification of the raw material and the solid particles being circulated to said fluidized bed combustion furnace for combustion of the char, said fluidized bed gasification method comprising varying a circulated amount of the solid particles in said fluidized bed combustion furnace in a range of kg/kg ratio between 6 and 30 to an air flow rate, wherein the circulated amount of the solid particles is varied using a particle takeoff device and a particle supplying device connected to a lower portion of the fluidized bed combustion furnace.

2. A fluidized bed gasification method as claimed in claim 1, wherein the circulated amount of solid particles to the air flow rate in the fluidized bed combustion furnace is within a range of 8-15.

3. A fluidized bed gasification method as claimed in claim 1, wherein an operating temperature of the fluidized bed combustion furnace is made lower than an ash fusion temperature of the raw material.

4. A fluidized bed gasification method as claimed in claim 1, wherein an operating temperature in the fluidized bed combustion furnace made lower than an ash fusion temperature of the raw material by 100° C.

5. A fluidized bed gasification method as claimed in claim 1, wherein solid particles are supplied to the fluidized bed combustion furnace or/and fluidized bed gasification furnace to increase the circulated amount of the solid particles.

6. A fluidized bed gasification method as claimed in claim 1, wherein the solid particles are discharged from the fluidized bed combustion furnace or/and fluidized bed gasification furnace to decrease the circulated amount of the solid particles.

7. A fluidized bed gasification method as claimed in claim 1, wherein introduction ratio between flow rate of primary air introduced through a bottom of the fluidized bed combustion furnace and flow rate of secondary air introduced sideways of the fluidized bed combustion furnace is varied.

8. A fluidized bed gasification method as claimed in claim 1, wherein the raw material is selected from a group consisting of coal, sub-bituminous coal, brown coal, lignite, biomass, waste plastic, heavy oil, residual oil and oil shale.

* * * * *